United States Patent [19]

Adams

[11] 4,153,374

[45] May 8, 1979

[54] HOMOGENIZER APPARATUS

[75] Inventor: Robert P. Adams, Walden, N.Y.

[73] Assignee: The Virtis Company, Inc., Gardiner, N.Y.

[21] Appl. No.: 892,253

[22] Filed: Mar. 31, 1978

[51] Int. Cl.[2] ..... B01F 11/00; B01F 7/00

[52] U.S. Cl. ..... 366/208; 366/249; 366/279

[58] Field of Search ..... 366/279, 197, 198, 206, 366/207, 208, 209, 242, 244, 247, 249, 251, 254, 605

[56] References Cited

U.S. PATENT DOCUMENTS

| | | | |
|---|---|---|---|
| 2,195,234 | 3/1940 | Brown | 366/251 X |
| 2,521,384 | 9/1950 | Marienthal | 366/249 |
| 2,894,309 | 7/1959 | Brzowski | 366/605 |

*Primary Examiner*—Edward J. McCarthy
*Attorney, Agent, or Firm*—Kirkland & Ellis

[57] ABSTRACT

Disclosed is improved homogenizer apparatus of the type capable of operating in the range of 60,000 revolutions per minute. A motor is mounted to a motor support frame structure which in turn is mounted to the cabinet of the homogenizer. Two shafts are mounted to the motor mounting frame and extend downwardly essentially parallel to a spindle operably connected to the motor. A lower flask base support and an upper flask clamp are mounted for sliding movement on the two shafts and clamps formed of a cylindrical member fabricated of a metal softer than the shafts to avoid marring or damage to the shafts are utilized to clamp the flask base and flask clamp in any desired position on the shafts. By attaching the shafts directly to the motor support frame, the flask base and flask clamp remain properly oriented and aligned with respect to the spindle irrespective of shipping and operation vibrations and other external forces. Thus, the likelihood of misalignment resulting from vibration or shipping damage is substantially eliminated.

2 Claims, 6 Drawing Figures

HOMOGENIZER APPARATUS

BACKGROUND OF THE INVENTION

1. Field of the Invention

The present invention relates to homogenizers, and more particularly, this invention relates to unique means of mounting and adjusting the position of homogenizer flasks in homogenizers.

2. Description of the Prior Art

Various types of homogenizers are well known in the art, and have been used for years for many different applications. For example, milk homogenizers have been known for a number of years. However, high speed homogenizers of the type for which the present invention is particularly suitable are typically used for laboratory or experimental purposes in the chemical, biological, and medical sciences. Such homogenizers generally operate at extremely high speeds with a typical speed capability in the range of 60,000 revolutions per minute. At such tremendously high rotational velocities, machine tolerances and alignments are particularly critical since any imbalance or misalignment can cause extreme vibration resulting in related damage to the equipment. One typical commercially available prior art homogenizer is illustrated in FIG. 5. One problem experienced by such prior art homogenizers has been alignment problems between the motor spindle and the flask supports occurring as a result of damage during shipment or vibration during operation.

The present invention overcomes the deficiencies of the prior art by reducing or eliminating the alignment problems as will be more fully described below.

BRIEF DESCRIPTION OF THE INVENTION

The present invention is for utilization and incorporation in a homogenizer of the type having a high-speed motor, a motor spindle operably connected to and rotated by the motor, a flask or container for holding the material to be homogenized, a lower flask base support, an upper flask clamp, a rotor mounted on a rotor shaft attached to the motor spindle and positioned such that the rotor is within the flask.

The improvement comprises a frame means for mounting the motor and spindle in a fixed positional relationship, and at least two shafts mounted at one end directly to the frame means and extending downwardly essentially parallel to the motor spindle. The lower flask base support and the upper flask clamp are slideably mounted on the shafts. Clamping means are provided for locking the lower flask base support and the upper flask clamp at any desired location along such shafts so that the flask can be retained between the lower flask base support and the flask clamp at a position where the rotor is properly positioned within the flask.

The clamping means comprises a cylindrical member fabricated from a metal softer than the shafts. The cylindrical member has a threaded opening through the cylindrical member essentially perpendicular to the cylindrical axis of the cylindrical member. A threaded screw member mounted for rotation on either the lower flask base support or the upper flask clamp is threaded through the threaded opening of a respective cylindrical member such that rotation of the screw member causes the cylindrical member to move to engage the shaft thereby locking the lower flask base support or the upper flask clamp to the shaft at any desired position. By fabricating the cylindrical members from a metal softer than the shafts, damage to the shafts is substantially eliminated during clamping.

Thus, it is a principal object of the present invention to provide improved structure for homogenizers that includes unified structure joining the motor and motor spindle and the flask supports and clamps thereby eliminating alignment problems in high-speed homogenizers.

Yet another object of the present invention is to provide unique clamping means for the flasks supports in high-speed homogenizers that permit easy positioning of the flange supports without causing damage to the structure.

These and other objects, advantages, and features shall hereinafter appear, and for the purposes of illustration, but not for limitation, an exemplary embodiment of the present invention is illustrated in the accompanying drawings and the detailed description.

DETAILED DESCRIPTION OF PREFERRED EMBODIMENT

Figure 5:
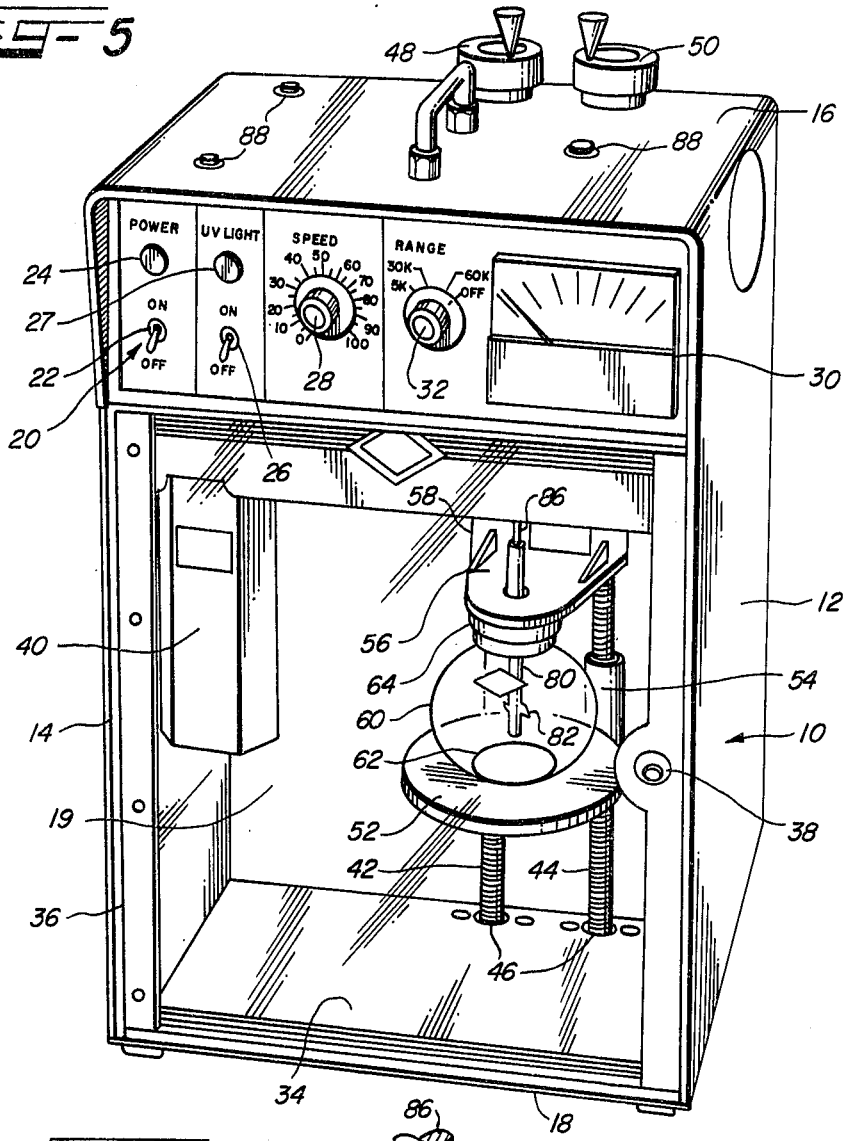
FIG. 5 is a right front perspective view of a prior art homogenizer.

With reference to FIG. 5, a conventional prior art 60,000 revolutions per minute homogenizer is illustrated. Since the present invention is an improvement to such a prior art homogenizer, the structure and operation of this prior art apparatus will be described first. The prior art homogenizer comprises a cabinet 10 including sidewalls 12 and 14, top wall 16, bottom wall 18 and back wall 19. On the front of the homogenizer is a control panel 20 which includes a power switch 22, a power indicator lamp 24, ultraviolet lamp switch 26, and an ultraviolet indicator lamp 27. The control panel 20 also includes a speed control knob 28 which controls the speed of a motor (not shown in FIG. 5), and a tachometer 30 which indicates the speed of operation. A tachometer range switch 32 which allows adjustment of the range of the tachometer is also mounted on control panel 20.

A glass door 34 having a clear glass front panel is mounted by hinges 36 along one edge thereof to the front edge of sidewall 14. A door latch 38 allows the door to be opened by the operator to gain access to the interior of cabinet 10. Within the interior of the cabinet 10 behind door 34 is an ultraviolet lamp and lamp shield 40. Also mounted within the interior cabinet 10 are two threaded shafts 42 and 44. These shafts are rotatably mounted at their lower ends to bottom wall 18 by bearings 46. The upper ends of the shafts 42 and 44 extend up through the cabinet 10 and out of top wall 16. Shafts 42 and 44 are rotatably mounted by bearings (not shown) to the top wall 16. A flask clamp positioning knob 48 is mounted on the end of shaft 42 and a flask base positioning knob 50 is mounted on the end of shaft 44. A flask base 52 is mounted on shafts 42 and 44 and the interior of an extension 54 of flask base 52 is threaded to engage threads on shaft 44 so that rotation of shaft 44 will cause flask base 52 to move upwardly or downwardly depending on the direction of rotation of knob 50.

Also mounted to shafts 42 and 44 is flask clamp 56. Flask clamp 56 has a threaded extension 58 which engages the threads on shaft 42 so that rotation of shaft 42 causes the flask clamp to move upwardly or downwardly depending upon the direction of rotation of shaft 42 by knob 48. A flask 60 is positioned on flask base 52. Recess on underside of flask clamp 56 is positioned to align flask 60 in the proper position with respect to the system.

Figure 6:
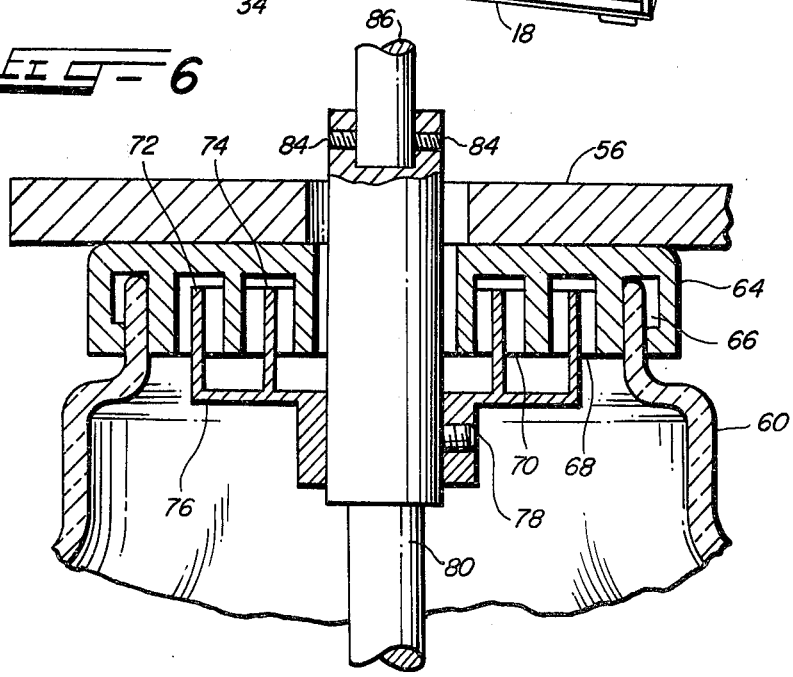
FIG. 6 is a cross sectional partially fragmentary view of the prior art flask cap and aerosol baffle arrangement that may be used in conjunction with the present invention.

With reference to both FIGS. 5 and 6, positioned on top of flask 60 is a cap 64 that has an annular groove 66 for receiving the top edge of flask 60. Two concentric annular grooves 68 and 70 are also formed in the lower surface of cap 64 and aligned to receive annular flanges 72 and 74 of an aerosol baffle 76. Baffle 76 is mounted by a set screw 78 to a shaft 80 one end of which has a homogenizing rotor 82 mounted thereto and the other end of which is attached by set screws 84 to spindle 86. The spindle 86 is operably connected to a motor controlled by power switch 22 so that rotation of spindle 86 causes the shaft 82 to rotate at very high speeds thereby causing rotor 82 to homogenize the contents of flask 60. Aerosol baffle 76 prevents the contents of flask 60 from being splashed out of the top of cap 64 through the opening around shaft 80.

As can be seen from the previous description of the prior art homogenizer, the vertical position of the flask base 52 and flask clamp 56 is dependent upon the size of the flask 60. The exact position of the base 52 and clamp 56 can be controlled by rotating knobs 48 and 50 until the proper vertical position is achieved. While this arrangement has been used for several years, several problems have occurred with this type of structure. Since the shafts 42 and 44 are mounted to the cabinet 10 but the motor spindle is mounted to a motor frame which is separately attached to the top wall 16 by the bolts 88 (see FIG. 5) it is possible that the spindle could become misaligned with respect to the shafts 42 and 44 either as a result of vibration or other external forces during shipment, vibration during operation or a sudden shock such as accidentally dropping the equipment during movement around the laboratory. Once misalignment resulted, damage to the aerosol baffle 76, cap 64, shaft 80 or spindle 86 could result.

The improvement of the present invention is illustrated in FIGS. 1, 2, 3, and 4. In FIGS. 1–4, structure that is common to the prior art homogenizer illustrated in FIGS. 5 and 6 will be designated in FIGS. 1–4 by the same numerals used in FIGS. 5 and 6. The following description will be principally directed to that structure which is either not disclosed in FIGS. 5 and 6 or is structurally different from the structure illustrated in FIGS. 5 and 6.

Figure 1:
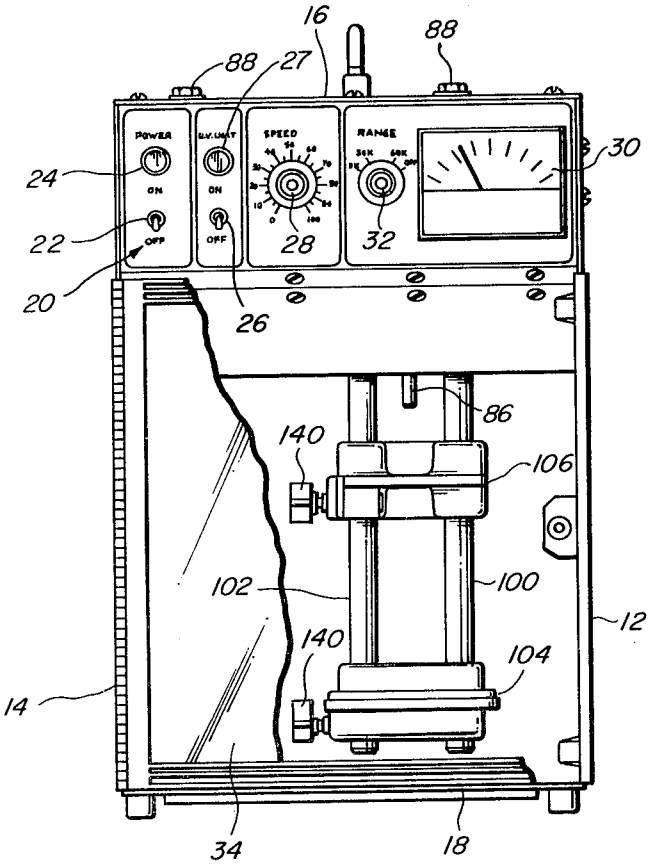
FIG. 1 is a front elevational view of a preferred embodiment of the present invention.
Figure 2:
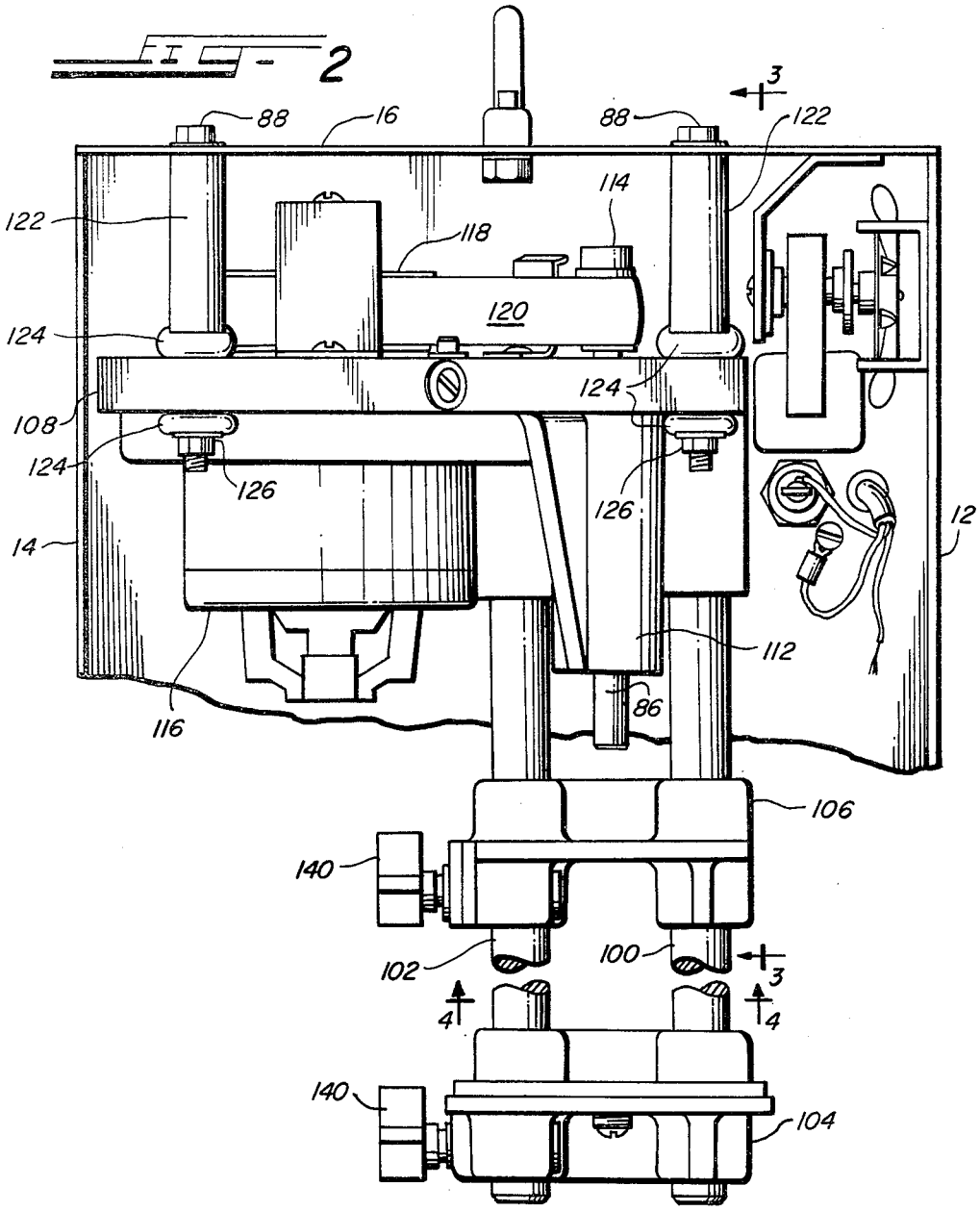
FIG. 2 is a front partially fragmentary view of the embodiment of FIG. 1 showing the structure within the cabinet behind the control panel.

With reference to FIGS. 1 and 2, it can be seen that two vertically aligned shafts 100 and 102 are positioned within cabinet 12 in much the same manner and alignment as in the prior art structure. However, the lower ends of shafts 100 and 102 are not mounted to the bottom wall but are free floating. A flask base 104 and a flask clamp 106 are slideably mounted on shafts 100 and 102 in a manner that will be more fully described hereinafter.

Figure 3:
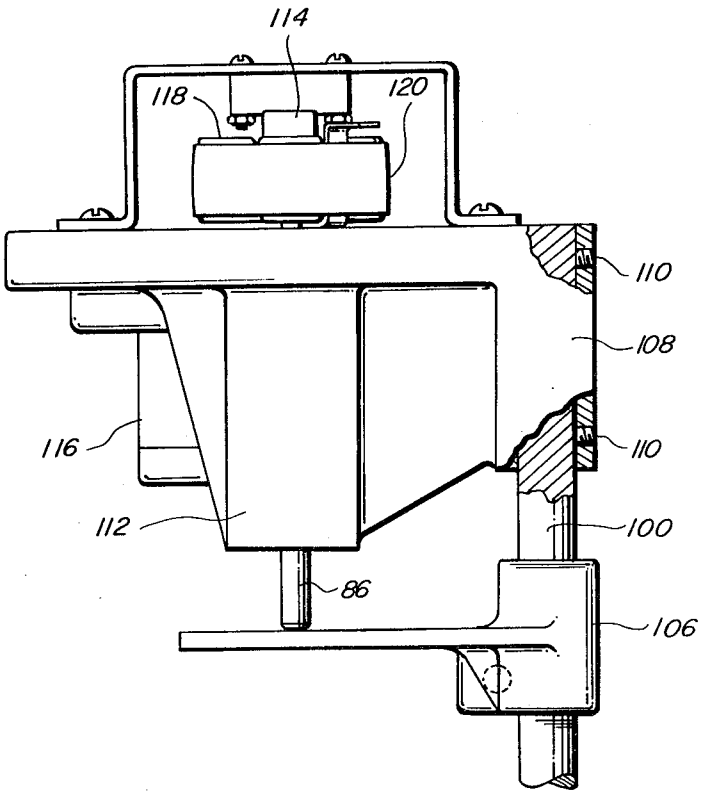
FIG. 3 is a side partially cross sectional, partially fragmentary view taken substantially along line 3—3 in FIG. 2.

With particular reference to FIGS. 2 and 3, the upper ends of shafts 100 and 102 extend through mating openings in a motor frame 108 and are locked thereto by set screws 110. Frame 108 includes a bearing housing 112 through which a spindle 86 is mounted for rotation. One end of spindle 86 extends below housing 112. The other end of spindle 86 extends from the top of frame 108 and a pulley 114 is mounted thereto. An electrical motor 116 is also mounted to frame 108, and attached to a rotating shaft of the motor 116 is a pulley 118 that is larger in diameter than pulley 114. Trained over pulleys 118 and 114 is a precision flat belt 120. Thus, rotation of motor 116 causes spindle 86 to rotate to a much higher speed because of the relative differences in the sizes of pulleys 114 and 118. Frame 108 is mounted to the top wall 16 of cabinet 10 by bolts 88 and nuts 126. The positional relationship of frame 108 is maintained by hollow cylindrical standoffs 122, and resilient vibration pads 124 allow minor vibration damping.

Figure 4:
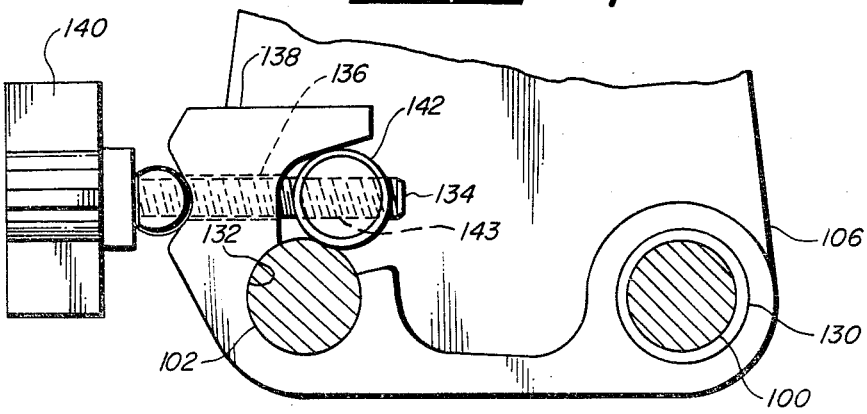
FIG. 4 is a bottom view of the flask base showing the clamping means taken substantially along line 4—4 in FIG. 2.

As can be seen, shafts 100 and 102 are locked directly to frame 108 so that no alignment problems can result with respect to the position of spindle 86. However, since shafts 100 and 102 are locked and cannot rotate, some means of allowing the adjustment of the flask base 104 and flask clamp 106 must be provided. With reference to FIG. 4, the clamping arrangement for both the flask base 104 and flask clamp 106 is illustrated. This structure is identical for both the flask base 104 and flask clamp 106, and FIG. 4 illustrates the clamp arrangement for the flask clamp 106.

As can be seen, flask clamp 106 has an opening 130 for slideably receiving shaft 100. Both holes 130 and 132 are tolerenced to permit a precision sliding fit. A threaded shaft 134 is positioned through circular opening 136 in a flange 138 on the bottom of clamp 106. Mounted on the end of threaded shaft 134 is a knob 140 and a cylindrical member 142 having a threaded opening 143 therethrough essentially perpendicular to the cylindrical central axis of member 142 receives and threadably engages the threaded shaft 134.

Thus, by rotating knob 140, shaft 134 is rotated causing cylindrical member 142 to move either to engage shaft 102 to lock clamp 106 to shaft 102, or to move away from shaft 102 to permit clamp 106 to be freely moved up and down shafts 102 and 100.

Cylindrical member 142 may be fabricated of brass or any other relatively soft metal. Shafts 100 and 102 are typically fabricated from stainless steel or any other suitable type of steel. By making cylindrical member 142 out of a softer metal, damage or marring of shaft 102 is avoided when clamping occurs. This is important since shafts 100 and 102 are precision machined and holes 130 and 132 are closely toleranced to assure a precision fit so that proper alignment is maintained. Damage to the shafts could interfere with the sliding fit.

It should be apparent that the unique clamp arrangement as illustrated in FIG. 4 permits an infinite range of adjustments along the shafts 100 and 102 without detracting from the ability of the clamp to securely clamp the base at any desired location. Moreover, since shafts 100 and 102 are mounted directly to the motor frame 108 these shafts remain in alignment with the spindle 86 irrespective of external forces or vibrations resulting from high speed operation or shipment. Further, since some harmonic vibrations can be experienced in any equipment that operates at such high rotational speeds, by locking the entire operative structure in a unified arrangement, the relative displacement of the various members as a result of the vibrational energy is substantially reduced thereby eliminating potential damage or wear.

It should be apparent that the present invention is not limited to any particular apparatus or structure and that various modifications, alterations, or changes may be made to the present invention without departing from the spirit and scope of the present invention as defined in the appended claims.

I claim:

1. In a homogenizer of the type having a motor, a spindle operably connected to and rotated by the motor, a flask for holding material to be homogenized, a lower flask base support and an upper flask clamp each adapted to retain the flask therebetween, a rotor mounted on a rotor shaft attached to the motor spindle, and positioned such that the rotor is within the flask; an improvement comprising:

frame means mounting the motor and spindle in a fixed positional relationship;

at least two shafts mounted at one end directly to the frame means and extending downwardly essentially parallel to the motor spindle, the lower flask base support and upper flask clamp being slideably mounted on said shafts;

clamping means for locking the lower flask base support and the upper flask clamp at any respective desired location along said shafts.

2. An improvement as claimed in claim 1 wherein said means for clamping comprises:

cylindrical members fabricated from a metal softer than said shafts, said cylindrical members having a threaded opening therethrough perpendicular to a cylindrical axis of said cylindrical members;

a first threaded screw member mounted for rotation on the lower flask support, and a second threaded screw member mounted for rotation on said upper flask clamp, said first and second screw members threaded into the threaded opening of a respective one of said cylindrical members;

said cylindrical members and said first and second screw members being respectively positioned on said lower flask support and said upper flask clamp in such a position that rotation of said screw members in one direction will move said cylindrical members into clamping engagement with one of said shafts and rotation of said screw members in the opposite direction moves said cylindrical members out of clamping engagement with one of said shafts.

* * * * *